US007024705B2

(12) United States Patent
Chiang

(10) Patent No.: US 7,024,705 B2
(45) Date of Patent: Apr. 11, 2006

(54) SWIMMING GOGGLES

(76) Inventor: Herman Chiang, 11F-2No. 634-9 Ching-Ping RD., Chung-Ho City, Taipei Hsien (TW)

( * ) Notice: Subject to any disclaimer, the term of this patent is extended or adjusted under 35 U.S.C. 154(b) by 266 days.

(21) Appl. No.: 10/396,784

(22) Filed: Mar. 26, 2003

(65) Prior Publication Data

US 2004/0187198 A1 Sep. 30, 2004

(51) Int. Cl.
*A61F 9/02* (2006.01)

(52) U.S. Cl. ..... 2/445
(58) Field of Classification Search ..... None
See application file for complete search history.

(56) References Cited

U.S. PATENT DOCUMENTS 6,119,277 A * 9/2000 Chiang ..... 2/428
6,247,187 B1 * 6/2001 Chiang ..... 2/428
6,349,417 B1 * 2/2002 Chiang ..... 2/428
6,505,352 B1 * 1/2003 Chiang ..... 2/428
6,530,093 B1 * 3/2003 Chiang ..... 2/428
6,546,565 B1 * 4/2003 Chiang ..... 2/428
6,581,213 B1 * 6/2003 Chiang ..... 2/428

* cited by examiner

*Primary Examiner*—Katherine M. Moran
(74) *Attorney, Agent, or Firm*—Troxell Law Office, PLLC

(57) ABSTRACT

A pair of swimming goggles of the present invention comprises a pair of left and right lens frames which respectively include an outer surface and an inner surface and receive a pair of lenses, a bridge member disposed at the upper edges of the inner sides of the left and right lens frames, and a head strap means disposed at the outer sides of the left and right lens frames. The feature of the present invention is that the head strap means at least includes a first thread, a second thread, and a pair of adjustment fasteners disposed at the first and second threads, wherein the first thread is disposed at the upper position of the outer sides of the left and right frames, and the second thread is disposed at the lower position of the outer sides of the left and right frames. Thus, the adjustment fasteners properly adjust the first and second threads thereby providing different application lengths for the first and second threads and providing a desired pull force such that the upper and lower edges of the lens frames are adjusted to comfortably contact with the periphery of the eye holes and a desired refraction effect of the lenses in water is achieved.

13 Claims, 7 Drawing Sheets

SWIMMING GOGGLES

FIELD OF THE INVENTION

The present invention relates to a pair of swimming goggles for swimming pool purposes, more particularly, a pair of swimming goggles with an improved strap head structure for providing a comfort wearing, and avoiding the seepage of water and an overly deflection of the swimming goggles in use.

DESCRIPTION OF THE RELATED ART

The head strap of the swimming goggles includes single thread type, double thread type, or a type of folding a single thread to function like double threads. Whatever the type is, the head strap of a prior art is disposed at a central position of the outer side of the lens frame. However, the area around the upper and lower positions of the eye holes and the nose bridge of a person is significantly unsmooth. When the swimming goggles are sleeved on the head and fixed, the head strap intendedly provides an equal pull force on the upper and low positions of the eye holes. However, when the lens frame is matched to the eye hole, the actual effect of the pull force is not desired. In other words, the unsmooth area at the upper and lower position of the eye holes causes deflection of the lens frames when the head strap is pulled in use. Therefore, such a deflection causes an undesired refraction effect of the lenses in water.

Moreover, a straightforward distance between an upper position of the eye hole and a back part of the head is larger than a straightforward distance between a lower position of the eye hole and a back part of the head. Thus, an upper edge of the lens frame is overly matched with the upper position of the eye hole such that the seepage of water would possibly occur at a lower position of the eye hole. For the swimming goggles which is a double thread type or a type of folding a single thread to function like double threads, a wearer usually downwardly pull the lower head strap thereby lengthening the head strap for overcoming above mentioned drawback. However, only by pulling the lower head strap, a corresponding downward slippage of the upper head strap may occur thereby causing unreliable wearing of the swimming goggles. Therefore, a wear commonly pull the upper head strap downwardly and pull the lower head strap upwardly thereby balancing the upward and downward pull forces. However, such a pulling method causes overly pull force applied on the upper position of the eye holes resulting in a discomfort of the wearer. For a single thread type swimming goggles in use, a wearer commonly upwardly pulls the head strap thereby lengthening an application length relative to the lower position of the eye holes resulting in a same discomfort feeling for the wearer.

SUMMARY OF THE INVENTION

Accordingly, the primary object of the present invention is to provide a pair of swimming goggles in which the straightforward distances between the upper and lower positions of the eye holes and the back part of the head can be properly adjusted thereby providing the proper pull force when wearing and providing the upper and lower edges of the lens frames to properly and comfortably contact the upper and lower positions of the eye holes.

A second object of the present invention is that a pair of head straps is adopted to properly pull the upper and lower edges of the lens frames thereby preventing a deflection of the lens frames in use resulting from an overly pull force thereby providing an desired refraction effect of the lenses in water.

The main feature of the swimming goggles of the present invention is that the head strap means of the swimming goggles at least includes a first thread, a second thread, and an adjustment fastener disposed at the first and second threads. The first thread is disposed at an upper position of the outer sides of the left and right lens frames and the second thread is disposed at a lower position of the outer sides of the left and right lens frames thereby providing adjustment of the different application lengths for the first and second threads.

DETAILED DESCRIPTION OF THE PREFERRED EMBODIMENTS

Figure 1:
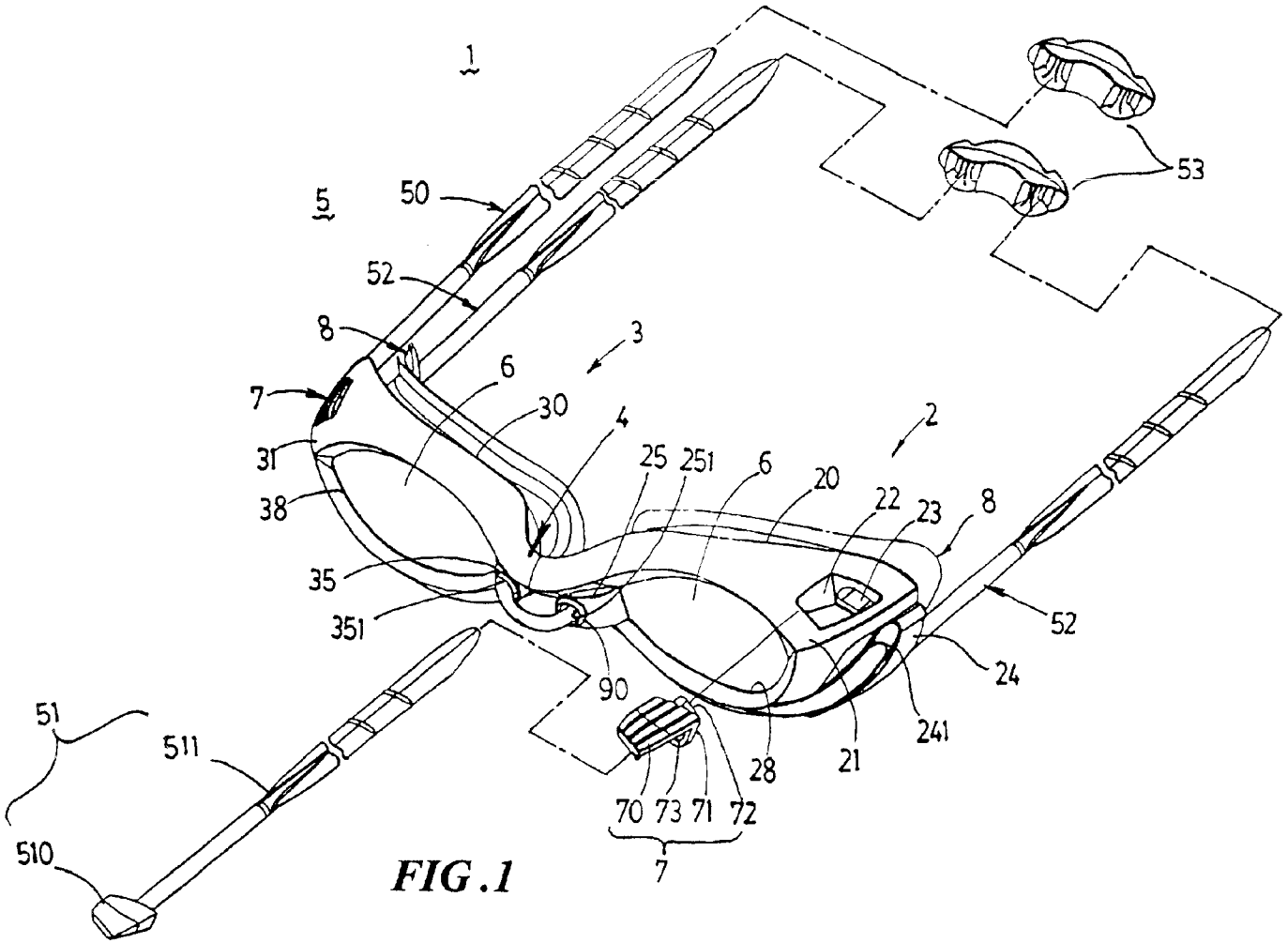
FIG. 1 is a perspective view of a pair of swimming goggles of the first embodiment of the present invention with a partial exploded view thereof.
Figure 2:
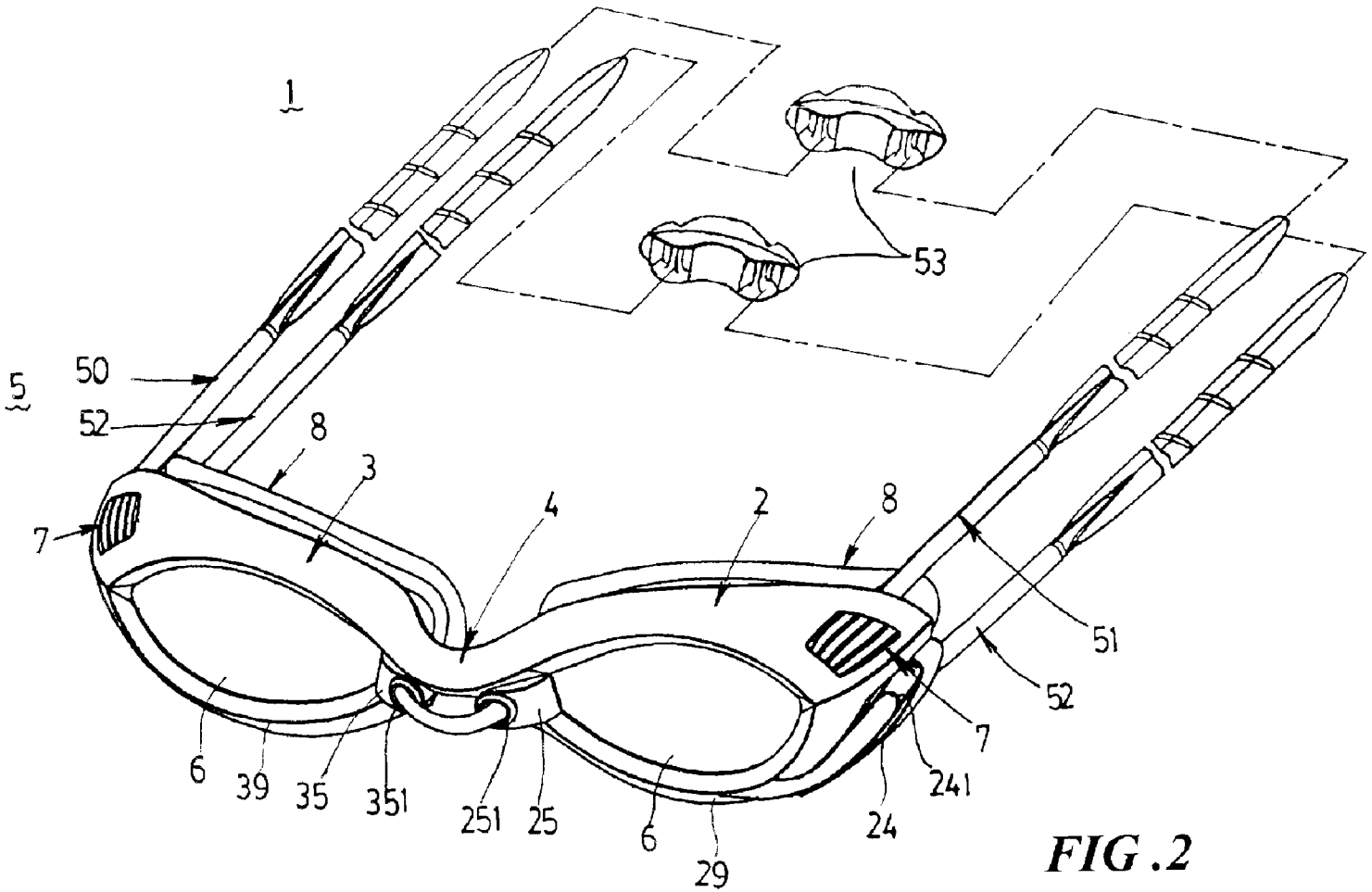
FIG. 2 is a perspective view of a pair of swimming goggles of the FIG. 1 with the second thread assembled.
Figure 3:
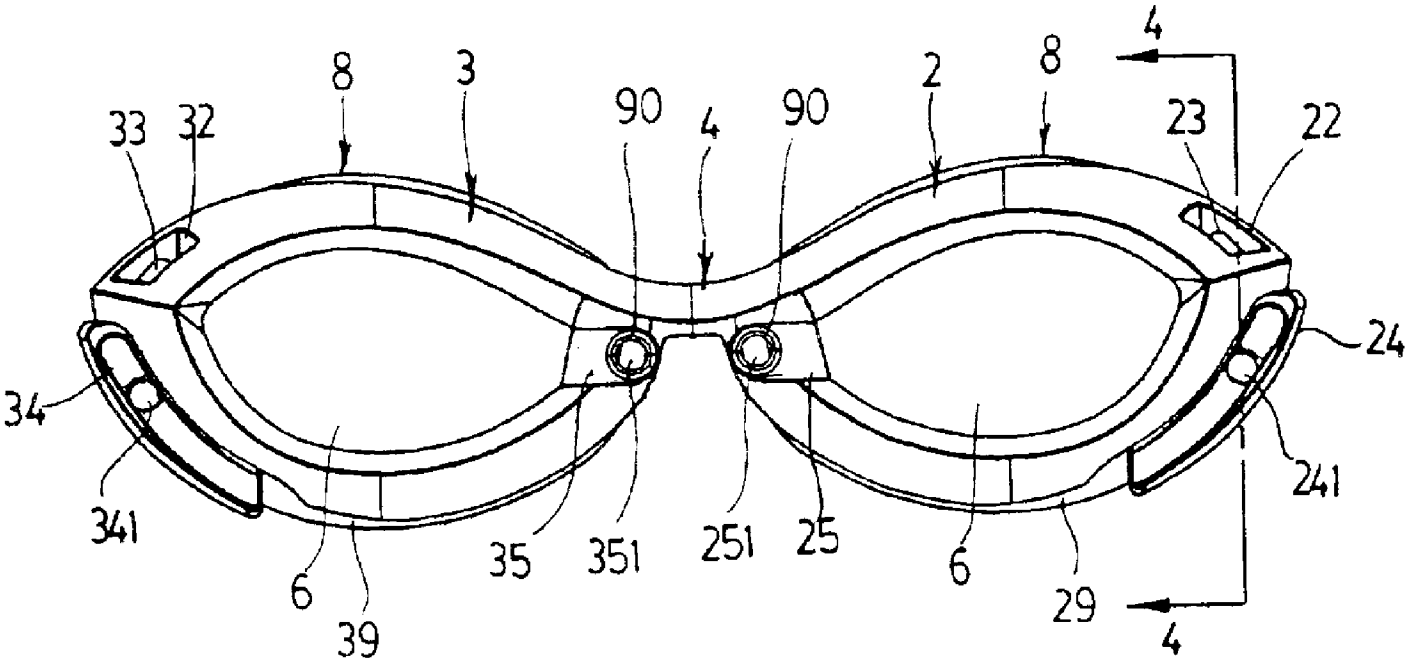
FIG. 3 is a front view of the lens frames, the bridge member and the gasket with an integral structure.

Referring to FIGS. 1 and 2, a pair of swimming goggles of the present invention comprises a left lens frame 2, a right lens frame 3, a bridge member 4, and a head strap means 5. The left and right lens frames 2, 3 respectively include inner surfaces 20, 30 and outer surface 21, 31, wherein a pair of receiving grooves 28, 38 is respectively defined between the inner surfaces 20, 30 and the outer surfaces 21, 31 for retaining a pair of lenses 6. A pair of gaskets 8 is integrally formed on the inner surfaces 20, 30 of the left and right lens frames 2, 3, respectively, for providing comfort contact with the eye holes of a wearer. Also referring to FIGS. 1 and 3, an identical structure is disposed on the lateral sides of the left and right lens frames 2, 3. A recess 22 is defined on the outer side of the left lens frame 2. The right lens frame 3 also defines a recess 32. A pair of elongated round assembly holes 23, 33 is defined within the recesses 22, 32, respectively.

A pair of rigid bodies 7 is assembled into the recesses 22, 32. The rigid body 7 includes a long protrusion 70 and a short protrusion 71. One side of the long protrusion 70 is adjacent to the short protrusion 71. The cross section of a pair of protrusions 70, 71 is L-shaped. The long protrusions 70 are properly assembled to the recesses 22, 32 and properly mantle the recesses 22, 32. The short protrusions 71 properly engage with inner sides of the recesses 23, 33 in which the assembly holes 23, 33 are defined. A strengthening protrusion 72 extending from the short protrusion 71 has an identical shape of structure corresponding to that of the assembly holes 23, 33. A passageway 73 defined in the strengthening protrusion 72 is in communication with each of the assembly holes 23, 33 for allowing a first and second threads 50, 51 to pass therethrough. Thus, the strengthening protrusions 72 are assembled into the assembly holes 23, 33 thereby strengthening the structures of the assembly holes 23, 33 and enhancing the rigidness of the recesses 23, 33 when wearing the swimming goggles.

Figure 5:
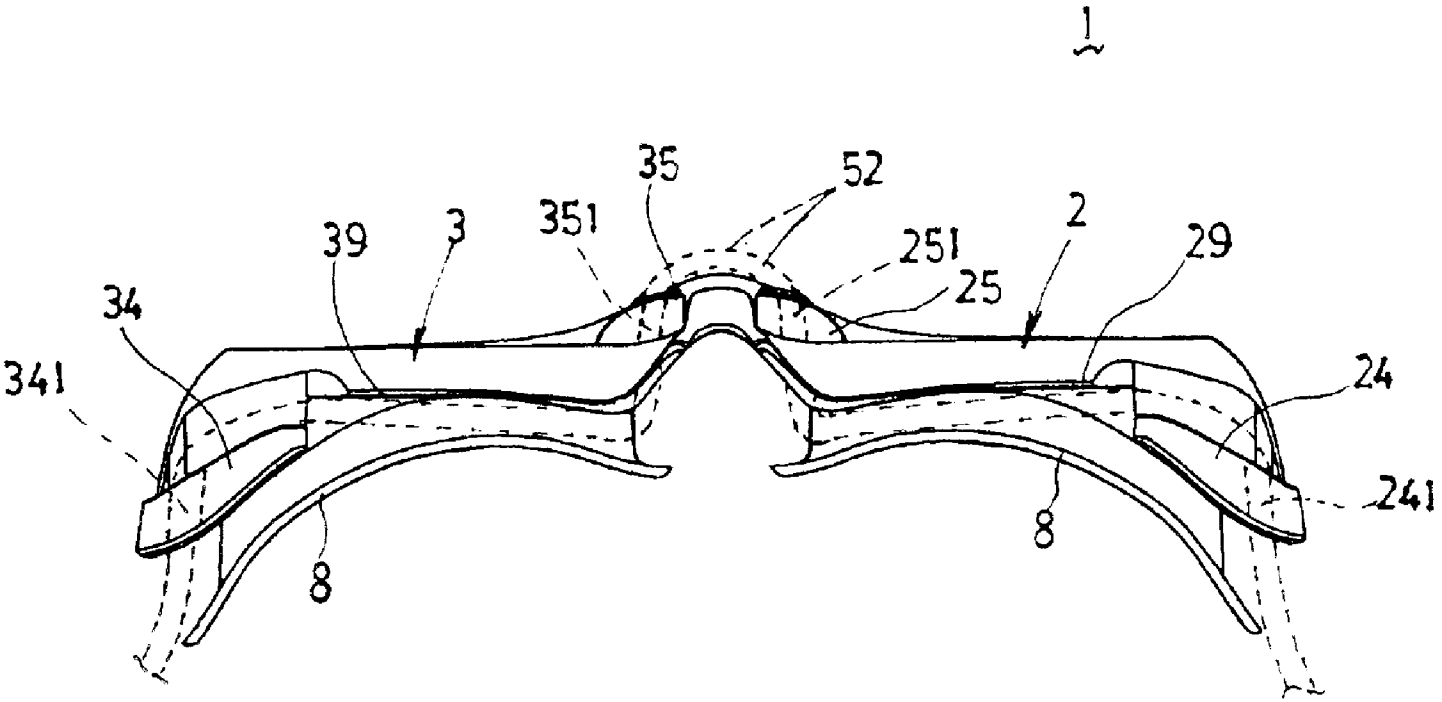
FIG. 5 a lateral view of the swimming goggles wherein a head strap is adjusted in the midst of the bridge member.

Additionally, a pair of first joint members 24, 34 formed at the lower positions of the recesses 22, 32 defines a pair of second holes 241, 341 for allowing a third thread 52 of the head strap means 5 to pass therethrough (detailed description later). A pair of second joint members 25, 35 is formed at the inner sides of the left and right lens frames 2, 3 and adjacent to the central position between the left and right lens frames 2, 3. A pair of adjustment holes 251, 351 is respectively defined in the second joint members 25, 35. A sleeve member 90 defining a passageway therethrough in communication with the environment at lateral ends thereof is assembled into each of the adjustment holes 251, 351 thereby strengthening the structure of the adjustment holes 251, 351 and facilitating the threads of the head strap means 5 to pass therethrough. Also referring to FIGS. 3 and 5, a pair of coupling grooves 29, 39 is respectively defined at the lower edges of the left and right lens frames 2, 3 and is reserved a certain distance from the first joint member 24. The third thread 52 of the head strap means 5 extends around the first joint members 24, 34 and the coupling grooves 29, 39, then is secured within the certain spaces between the coupling grooves 29, 39 and the second joint members 24, 34. Afterwards, the third thread 52 is pulled straightforwardly for facilitating balancing the swimming goggles in use. The bridge member 4 is integrally formed at the upper edges of the inner sides of the left and right lens frames 2, 3 and is adjacent to the top of the second joint members 25, 35.

Figure 4:
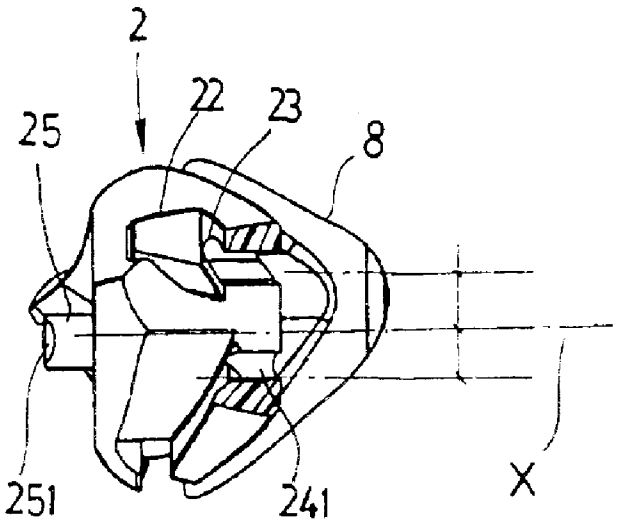
FIG. 4 is a cross-sectional view of the FIG. 3 taken from 4—4.

Referring to FIG. 1 again, the head strap means 5 includes the first thread 50, the second thread 51, the third thread 52, and a pair of adjustment fasteners 53. The first and second threads 50, 51 with the same structure are assembled into the assembly holes 23, 33, respectively. For better illustration, the second thread 51 is separated from the swimming goggles. As shown in FIG. 1, the second thread 51 includes a coupling end 510 and a free end 511. The coupling end 510 having a structure corresponding to that of the recess 22 of the aforementioned left lens frame 2 extends through the passageway 73 of the L-shaped rigid body 7, then is assembled into the recess 22 to fill up the recess 22. The upper surface of the long protrusion 70 of the L-shaped rigid body 7 is coplanar with the upper opening plane of the recess 22. One section of the coupling end 510 of the second thread 51 has a round structure and the other section of the free end 511 of the second thread 51 has a flat structure thereby facilitating the insertion of the thread through the passageway 73 of the L-shaped rigid body 7 in assembly. The third thread 52 shown as the broken lines in FIG. 5 extends through firstly the second hole 341 of the right lens frame 3, secondly the adjustment holes 351, 251 of the joint members 35, 25, and thirdly the second hole 241 of the left lens frame 2, and is secured by the certain spaces between the coupling grooves 29, 39 and the first joint members 24, 34. It is noted that referring to FIG. 4 which is a lateral view of the present invention, the assembly holes 23 and the second holes 241 are respectively disposed at each side of the horizontal central line X of the hole 251 of the second joint member 25, i.e. at each side of the horizontal central line of the left and right lens frame 2, 3 thereby facilitating balancing the pull force of the first and second threads 50, 51 when in use.

The adjustment fasteners 53 are disposed at the first, second threads 50, 51 and third thread 52 for adjusting the length of the threads. It is noted that the part of the third thread 52 disposed within the bridge member 4 can be adjusted according to the height of the nose bridge of a wearer. Shown as the broken lines of FIG. 5, by pulling the third thread 52, the wearer can adjust the third thread 52 according to the height of his own nose bridge. After adjustment, a part of the third thread 52 disposed adjacent to the second joint members 25, 35 is secured by the certain spaces between the coupling grooves 29, 39 and the first joint members 24, 34. Thus, when by pulling the head strap, the swimming goggles are sleeved on the head and fixed, the first joint members 24, 34 bear the pull force such that the above mentioned part of the third thread 52 would not be affected and the undesired deformation of the lens frames is avoided. Additionally, a straightforward distance between a lower position of the eye holes and a back part of the head of is relatively short. By adjusting the adjustment fastener 53 the application length of the third thread 52 is adjusted. A straightforward distance between an upper position of the eye holes and a back part of the head is relatively long. By adjusting another adjustment fastener 53 the application length of the first and second threads 50, 51 is adjusted. Therefore, a proper pull force is provided for wearing the swimming goggles such that the upper and lower edges of the left and the right lens frames 2, 3 are adjusted to comfortably match the periphery of the wearer's eye holes. Since the upper and lower edges of the lens frames are pulled by a pair of the head straps, a deflection of the lens frames due to an overly pull force in use is prevented thereby providing a desired refraction effect of the lenses 6 in water.

Figure 6:
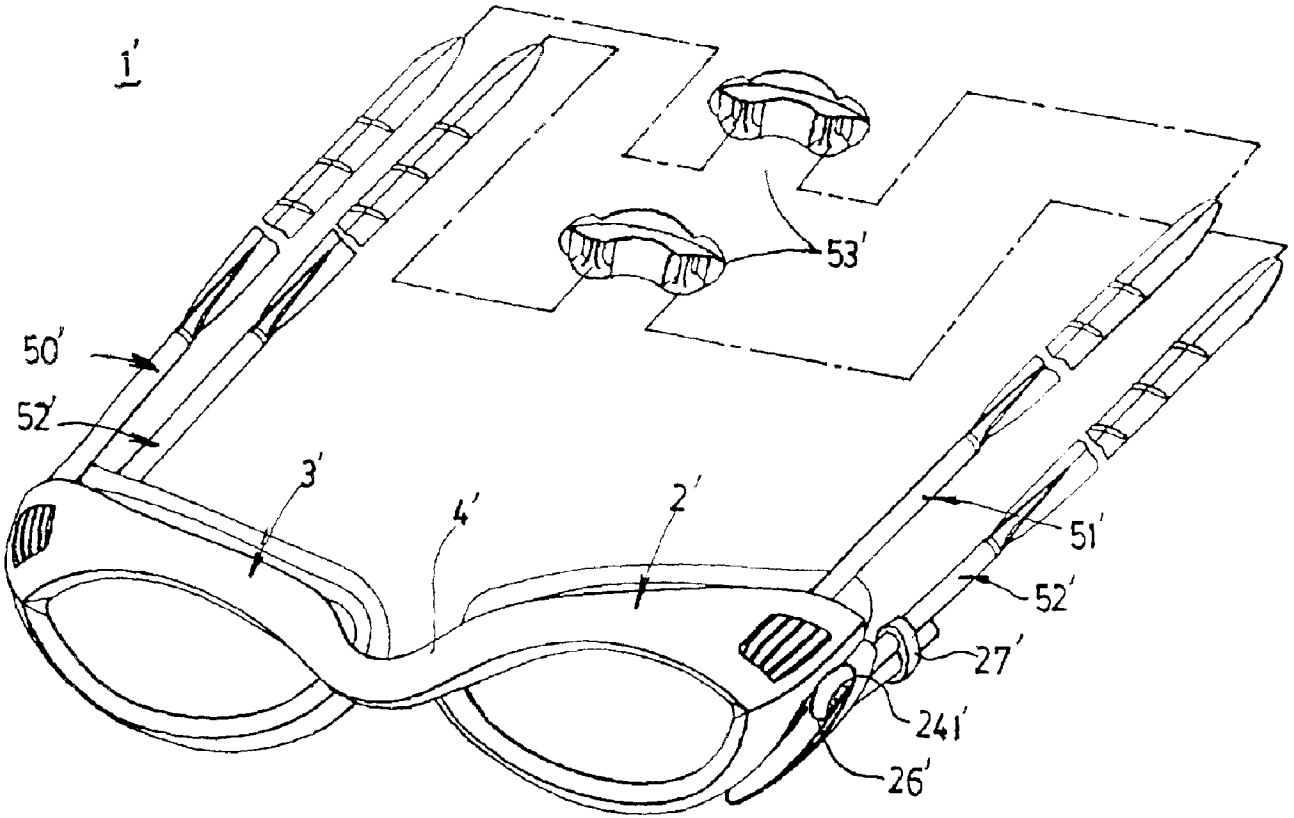
FIG. 6 is a perspective view of a second embodiment of the present invention.
Figure 7:
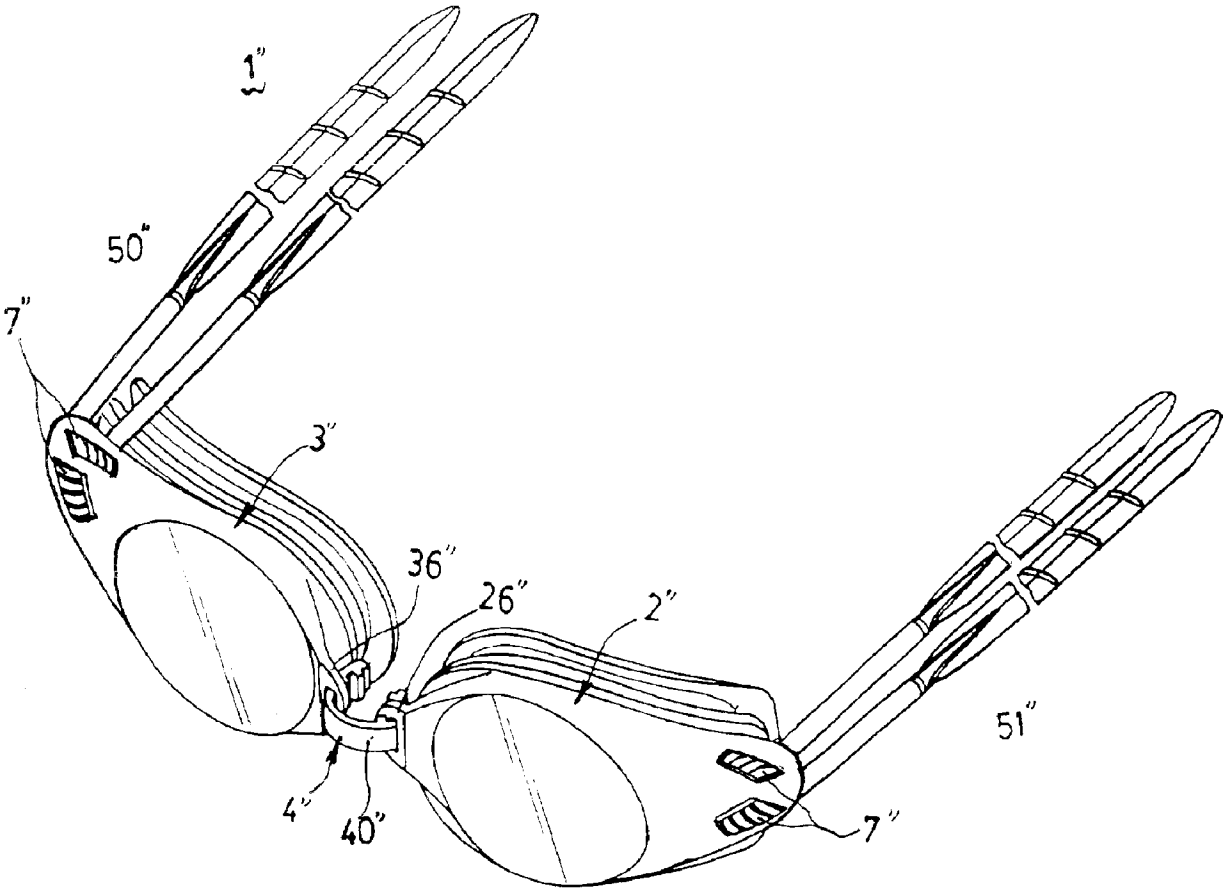
FIG. 7 is a perspective view of a third embodiment of the present invention.

Also referring to FIGS. 6 and 7 in which the swimming goggles 1', 1" of a second and third embodiments of the present invention are shown, the second and third embodiments have the same main structure with the first embodiment. The difference therebetween lies in that the swimming goggles 1' of the second embodiment shown in FIG. 6 have not a second joint member and include a third hole 26' and a fastening member 27'. The inner sides of the left and right lens frames 2', 3' are only integrally interconnected by a bridge member 4'. The first and second threads 50', 51' respectively extend through the second holes 241' disposed at the outer sides of the left and right lens frames 2', 3' (the second hole of the right lens frame 3' is not shown). The third thread 52' includes a pair of sections. One end of each the section has a round shaped and the other end of the section has a flat shaped for facilitating the insertion of the third thread 52' through the third holes 26' of the left and right lens frames 2', 3', and the fastening members 27' in assembly. The round shaped free end thereof extends through the third hole 26', and then is secured by the corresponding fastening member 27'. The purposes for adjustment of the first, second and third threads 50', 51', and 52' by respectively adjusting a pair of adjustment fasteners 53 are equally achieved.

The swimming goggles 1" of the third embodiment shown in FIG. 7 are featured in the arrangement of the bridge member 4". The bridge member 4" includes an adjustment fastener 40" which interconnects a pair of joint holes 26", 36" defined at the inner sides of the left and right lens frames 2", 3". The outer sides of the left and right lens frames 2", 3" define a pair of recesses as shown in the first embodiment for being assembled with the first and second threads 50", 51". The first and second threads 50", 51" are assembled with the rigid bodies 7". Therefore, the purposes for respective adjustment of the first and second threads 50", 51" and providing the swimming goggles of the present invention a proper and comfort contact with the eye holes are equally achieved.

Although the invention has been explained in relation to its preferred embodiments, it is to be understood that many other possible modifications and variations can be made without departing from the spirit and scope of the invention as hereinafter claimed.

What is claimed is:

1. A pair of swimming goggles, comprises:

a left lens frame and a right lens frame, each lens frame including an outer surface and an inner surface, a receiving groove being defined between the inner and outer surfaces for receiving a lens;

a bridge member disposed at the inner sides of the left and right lens frames; and a head strap means, including a first and second threads respectively disposed at an upper position of the outer sides of the left and right lens frames, a third thread disposed at a lower position of the outer sides of the left and right lens frames, and an adjustment fastener disposed at each of the first, second and third threads, wherein a recess is defined on an upper position of the outer side of each of the left and right lens frames, wherein an elongated round assembly hole is defined within the recess for allowing the first and second threads to extend therethrough, wherein a rigid body defining a hole therethrough is assembled into the recess for preventing an undesired deformation of the recess caused by pull force in use when the first and second threads extend through the recess.

2. The swimming goggles as claimed in claim 1, wherein a strengthening protrusion extending at the hole of the rigid body defines a passageway in communication with the hole, the strengthening protrusions being assembled into the assembly hole of the recess thereby strengthening the structures of the assembly hole and enhancing the rigidness of the recess when the first and second threads extend therethrough.

3. The swimming goggles as claimed in claim 2, wherein the rigid body includes a long protrusion assembled into the recess and properly mantling the recess, and at least a short protrusion properly engaging with inner side of the recess in which the assembly hole is defined, the strengthening protrusion extending from the short protrusion and defining a passageway for allowing the first and second thread to pass therethrough.

4. The swimming goggles as claimed in claim 3, wherein one side of the long protrusion is adjacent to the short protrusion, the cross section of a pair of long and short protrusions being L-shaped.

5. The swimming goggles as claimed in claim 4, wherein the bridge member is integrally formed at the upper edges of the inner sides of the left and right lens frames.

6. The swimming goggles as claimed in claim 4, wherein a first joint member formed below the recess of each left and right lens frames defines a second hole, a second joint member being formed at the inner sides of the left and right lens frames and below the bridge member, an adjustment hole being defined in each of the second joint members for allowing the third thread to extend through the respective second holes of the lens frames, and then the adjustment hole, afterwards the second hole of another lens frame.

7. The swimming goggles as claimed in claim 5, wherein a coupling grooves is defined at the lower edge of each of the left and right lens frames and is reserved a certain distance from the first joint member for allowing the third thread to extend around the first joint member and the coupling groove then to be secured within the certain spaces between the coupling groove and the second joint member.

8. The swimming goggles as claimed in claim 7, wherein a sleeve member defining a passageway therethrough in communication with the environment at lateral ends thereof is assembled into the adjustment hole of the second joint member thereby strengthening the structure of the adjustment hole and facilitating the threads to pass therethrough.

9. The swimming goggles as claimed in claim 1, wherein each of the first and second threads includes a coupling end and a free end extending from the coupling end, the coupling end having a structure corresponding to that of the recess and extending through the L-shaped rigid body, then being assembled into the recess to filling up the recess, one end of the free end having a round structure and the other end thereof having a flat structure thereby facilitating the insertion in assembly.

10. A pair of swimming goggles, comprises:

a left lens frame and a right lens frame, each lens frame including an outer surface and an inner surface, a receiving groove being defined between the inner and outer surfaces for receiving a lens;

a bridge member disposed at the inner sides of the left and right lens frames; and a head strap means, including a first and second threads respectively disposed at an upper position of the outer sides of the left and right lens frames, a third thread disposed at a lower position of the outer sides of the left and right lens frames, and an adjustment fastener disposed at each of the first, second and third threads, wherein a recess is defined on an upper position of the outer side of each of the left and right lens frames, wherein an elongated round assembly hole is defined within the recess for allowing the first and second threads to extend therethrough, wherein a first joint member outwardly formed below the recess defines a second hole and a third hole for allowing the third thread to pass therethrough, wherein the third thread includes a round shaped free end and a flat shaped free end for facilitating the insertion, the round shaped free end thereof extending through the third hole and then being secured by the corresponding fastening member.

11. A pair of swimming goggles, comprises:

a left lens frame and a right lens frame, each lens frame including an outer surface and an inner surface, a receiving groove being defined between the inner and outer surfaces for receiving a lens;

a bridge member disposed at the inner sides of the left and right lens frames;

a head strap means disposed at the outer side of each of the left and right lens frames, including a first thread, a second thread and an adjustment fastener disposed at each of the first and second threads, wherein a pair of upper and lower recesses is defined at the outer sides of the left and right lens frames, an elongated round assembly holes being defined within the recess adjacent to the side of the inner surface of each of the left and right lens frames for allowing the insertion of the first and second threads therethrough, wherein the first and second threads are respectively disposed at each side of the horizontal central line of the left and right lens frames, wherein a rigid body defining a hole therethrough is assembled into the recess for preventing an undesired deformation of the recess caused by pull force in use when the first and second threads extend through the recess.

12. The swimming goggles as claimed in claim 11, wherein a strengthening protrusion extending at the hole of the rigid body defines a passageway in communication with the hole, the strengthening protrusions being assembled into the assembly hole of the recess thereby strengthening the structures of the assembly hole and enhancing the rigidness of the recess when the first and second threads extend therethrough.

13. The swimming goggles as claimed in claim 12, wherein the rigid body includes a long protrusion assembled into the recess and properly mantling the recess, and at least a short protrusion properly engaging with inner side of the recess in which the assembly hole is defined, the short protrusion defining a passageway for allowing the first and second thread to pass therethrough.

* * * * *